US006367558B1

(12) United States Patent
Borak, Jr.

(10) Patent No.: US 6,367,558 B1
(45) Date of Patent: Apr. 9, 2002

(54) METAL-TO-METAL CASING PACKOFF

(75) Inventor: Eugene A. Borak, Jr., Cypress, TX (US)

(73) Assignee: ABB Vetco Gray Inc., Houston, TX (US)

( * ) Notice: Subject to any disclaimer, the term of this patent is extended or adjusted under 35 U.S.C. 154(b) by 0 days.

(21) Appl. No.: 09/691,868

(22) Filed: Oct. 19, 2000

Related U.S. Application Data

(60) Provisional application No. 60/160,581, filed on Oct. 20, 1999.

(51) Int. Cl.[7] ..... E21B 33/02

(52) U.S. Cl. ..... 166/387; 166/195; 166/181; 277/191

(58) Field of Search ..... 166/378, 379, 166/387, 381, 182, 181, 115, 116, 195, 328; 277/191

(56) References Cited

U.S. PATENT DOCUMENTS

| | | | | |
|---|---|---|---|---|
| 4,131,287 A | * | 12/1978 | Gunderson et al. | 277/191 |
| 4,665,979 A | | 5/1987 | Boehm, Jr. | 166/208 |
| 4,714,111 A | * | 12/1987 | Brammer | 166/182 |
| 4,742,874 A | * | 5/1988 | Gullion | 166/348 |
| 4,900,041 A | * | 2/1990 | Hopkins et al. | 277/328 |
| 4,932,472 A | | 6/1990 | Boehm, Jr. | 166/208 |
| 4,949,786 A | | 8/1990 | Eckert et al. | 166/208 |
| 5,060,724 A | | 10/1991 | Brammer et al. | 166/208 |
| 5,174,376 A | * | 12/1992 | Singeetham | 166/208 |
| 5,285,853 A | | 2/1994 | Eckert et al. | 166/382 |
| 5,325,925 A | * | 7/1994 | Smith et al. | 166/387 |
| 5,456,314 A | | 10/1995 | Boehm, Jr et al. | 166/208 |

FOREIGN PATENT DOCUMENTS

| | | | |
|---|---|---|---|
| GB | 2217795 A | 1/1989 | F16J/15/08 |

OTHER PUBLICATIONS

*Regan Offshore International, INC.*33300–H, Article on Regan Stack Saver Type SS–1 DRWG. No. 33300–N.

* cited by examiner

*Primary Examiner*—Frank S. Tsay
(74) *Attorney, Agent, or Firm*—Bracewell & Patterson, L.L.P.

(57) ABSTRACT

An all-metal seal assembly is located between the exterior of a string of casing and the bore of a lower wellhead housing. The seal assembly has abase seal member with inner and outer legs that define a U-shaped cross-section extending upward into the bore. Each leg is provided with a set of seal bands for sealing against the bore and casing, respectively. When an upper wellhead housing is landed on top of the lower wellhead housing, an energizing ring is forced into the U-shaped cross-section and spreads the legs apart from each other, thereby moving the two sets of seal bands into sealing engagement with the bore and the casing.

14 Claims, 4 Drawing Sheets

METAL-TO-METAL CASING PACKOFF

This application claims the benefit of U.S. Provisional Application No. 60/160,581 filed Oct. 20, 1999.

BACKGROUND OF THE INVENTION

1. Technical Field

The present invention relates in general to an improved wellhead seal, and in particular to an improved metal-to-metal casing packoff.

2. Description of the Prior Art

In general, prior art casing packoffs typically utilize elastomer seals. Unfortunately, most elastomer seals cannot meet the API PR2 testing for packoffs, as outlined in API 6A, $17^{th}$ edition, appendix F, without some type of special field machining to the casing. Some packoffs have been of the metal-to-metal sealing type, but again require the casing to be field machined and special sealing tapers in the wellhead housing.

In contrast, the packoff of the present invention combines several sealing features in one assembly to achieve a metal-to-metal primary and cross-over packoff. This packoff meets the API PR2 packoff testing requirements of API 6A, $17^{th}$ edition, appendix F. In addition, the present invention can be used in high temperature (above 350 degrees F) and high pressure (in excess of 10,000 psi), without the need for special field machining. A packoff constructed in accordance with the present invention is also the primary seal for slip-type casing hangers during service (FIG. 4).

SUMMARY OF THE INVENTION

An all-metal seal assembly is located between the exterior of a string of casing and the bore of a lower wellhead housing. The seal assembly has a base seal member with inner and outer legs that define a U-shaped cross-section extending upward into the bore. Each leg is provided with a set of seal bands for sealing against the bore and casing, respectively. When an upper wellhead housing is landed on top of the lower wellhead housing, an energizing ring is forced into the U-shaped cross-section and spreads the legs apart from each other, thereby moving the two sets of seal bands into sealing engagement with the bore and the casing.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

Figure 1:
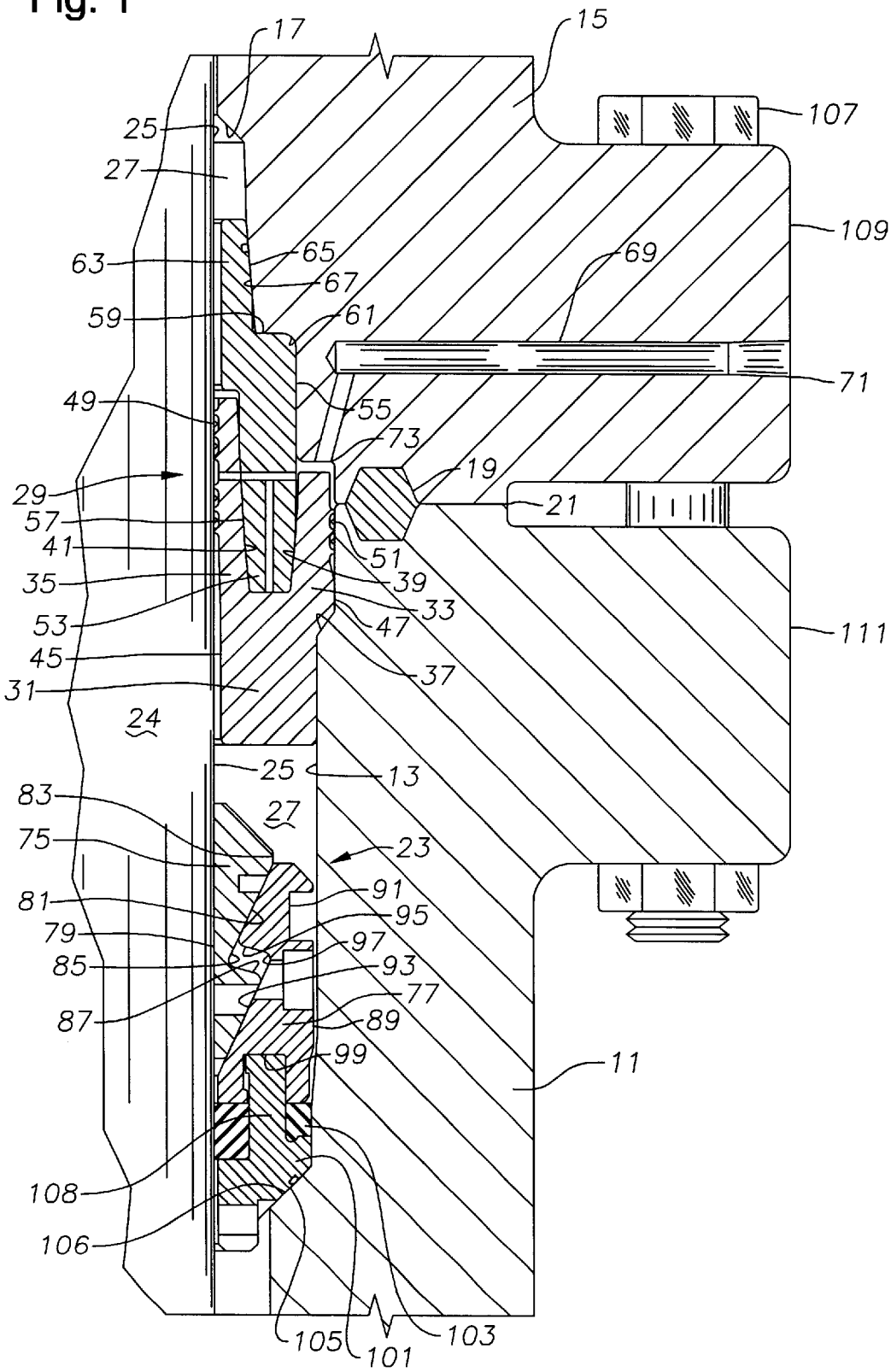
FIG. 1 is a half-sectional view of a metal-to-metal casing packoff constructed in accordance with the present invention and shown landed in a wellhead housing.

In accordance with the present invention, referring to FIG. 1, lower wellhead housing member 11 is conventional. It is a large tubular member located at the upper end of a well. Lower wellhead housing 11 has an annular, axial bore 13 extending through it. An upper wellhead housing member 15, also containing an annular, axial bore 17, lands on the lower wellhead housing 11. When the housings 11, 15 are clamped together, gasket seal 19 located between the abutting faces closes the seam 21 between the housings 11, 15. Prior to installing upper wellhead housing 15 on the lower wellhead housing 11, casing hanger 23 lands in the wellhead housing 11. Casing hanger 23 supports the upper end of a string of casing 24. The exterior wall 25 of casing 24 is parallel to the wall of bores 13, 17 but spaced inwardly. This results in an annular pocket or clearance 27 between casing exterior wall 25 and bores 13, 17

A seal assembly 29 lands in pocket 27 between casing hanger exterior wall 25 and bore walls 13, 17. Seal assembly 29 is made up entirely of metallic components. These components include a tubular or annular seal member 31 that is U-shaped in cross-section. Seal member 31 has an outer ring-like wall or leg 33 and a substantially parallel inner ring-like wall or leg 35, the legs 33,35 being connected together at the bottom by a base and open at the top. Outer leg 33 lands on a shoulder 37 in bore 13. The inner diameter 39 of outer leg 33 is radially spaced outward from the outer diameter 41 of inner leg 35. This results in an annular channel or clearance 43 (FIG. 2) between legs 33,35. The inner diameter 39 and the outer diameter 41 are smooth cylindrical surfaces that are substantially parallel to each other. Similarly, the inner diameter 45 of inner leg 35 and the outer diameter 47 of outer leg 33 are smooth, cylindrical, substantially parallel surfaces, except for seal bands 49, 51. A set of seal bands 49 is located on the inner diameter 45 of inner leg 35. A similar set of seal bands 51 is located radially across on the outer diameter 47 of outer leg 33. Seal bands 49, 51 form grooves between them that contain a soft metallic inlay that enhance the seal.

An energizing ring 53 is employed to force legs 33,35 radially apart from each other, moving seal bands 51, 49 into sealing engagement with the wall of bore 13 and exterior wall 25, respectively. Energizing ring 53 has an outer diameter 55 that will frictionally engage the outer leg inner diameter 39. Energizing ring 53 has an inner diameter 57 that will frictionally engage the inner leg outer diameter 41. The radial thickness of energizing ring 53 is greater than the initial radial dimension of the clearance 43. The energizing ring 53 has a L-shaped bend, creating upward facing shoulder 59 on the outside diameter 55. Energizing member 53 extends up into bore 17 of upper wellhead housing member 15. The wall of bore 17 has a mating downward facing shoulder 61 that abuts the shoulder 59 of the energizing ring 53. Energizing ring 53 has an upper portion 63 that extends upward from shoulder 59 above inner diameter 57. The outer surface 65 of upper portion 63 is tapered and forms a metal-to-metal seal with a tapered portion 67 in bore 17.

Passage 69 extends thru upper wellhead housing member 15 and has two openings 71, 73. The first opening 71 on the outer surface of the upper wellhead housing member 15 allows access for pressure testing. The second opening is on outer surface 65 of bore 17 slightly above the seam 21.

Below the seal assembly 29, is a casing hanger 23 having a plurality of slips 75 and a bowl 77 for supporting the weight of casing 24. The inner diameter 79 of slip 75 is a smooth, cylindrical surface that frictionally engages the casing exterior wall 25. The outer diameter 81 of slips 75 is S-shaped, consisting of wedge 83 on the upper portion and slot 85 and wedge 87 on the lower portion. Additionally, the outer diameter 89 of bowl 77 is a smooth, cylindrical surface that frictionally engages the wall of bore 13. Outer diameter 89 contains recess 91. The inner diameter 93 of bowl 77 has a wedge 95 and a slot 97 that are complementary to slips 75. The bottom surface of bowl 77 contains recess 99. Stop 101 protrudes upwards through an elastomeric seal 103 into recess 99. Backstop 105 of stop 101 is angled to engage a load shoulder 106 in the wall of bore 13. Stop 105 is larger in width than the clearance between the casing exterior wall 25 and the wall of bore 13.

Figure 2:
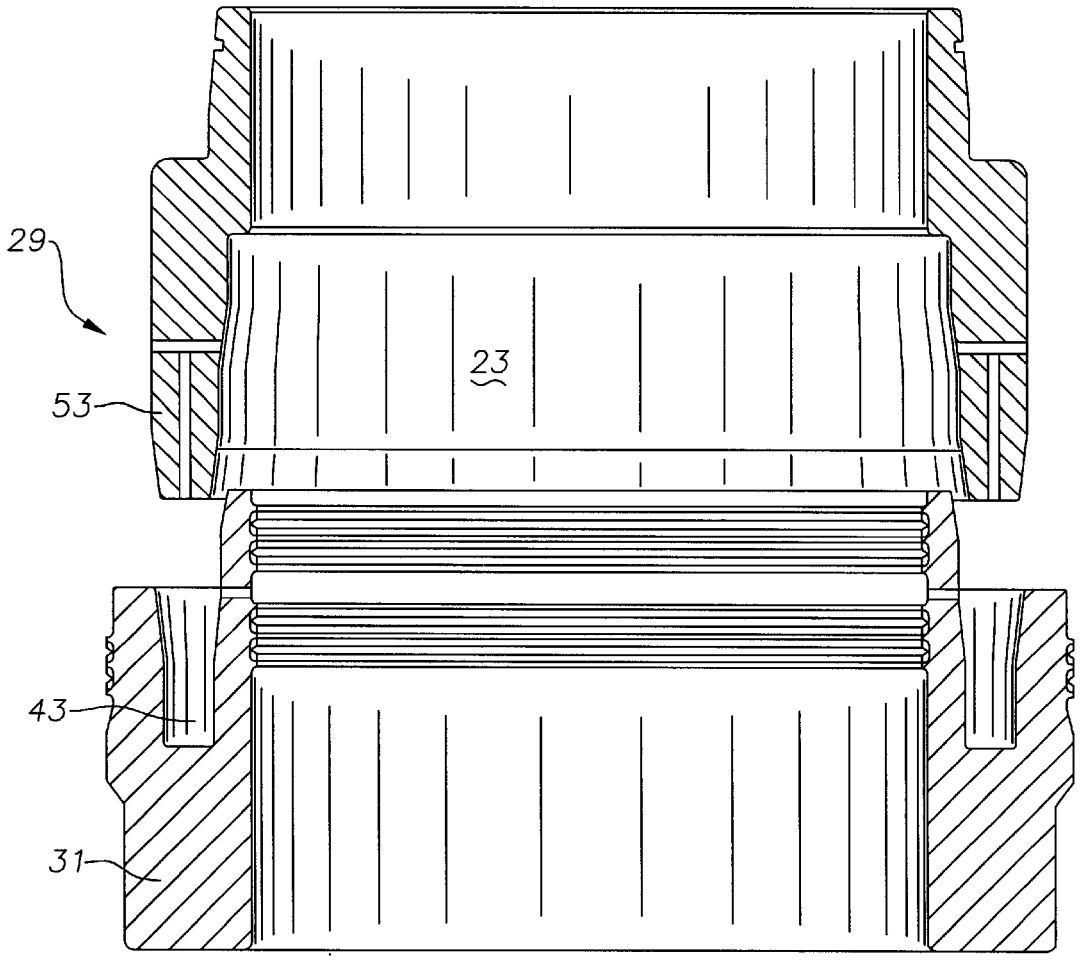
FIG. 2 is a sectional view of the packoff of FIG. 1 shown prior to energizing.
Figure 3:
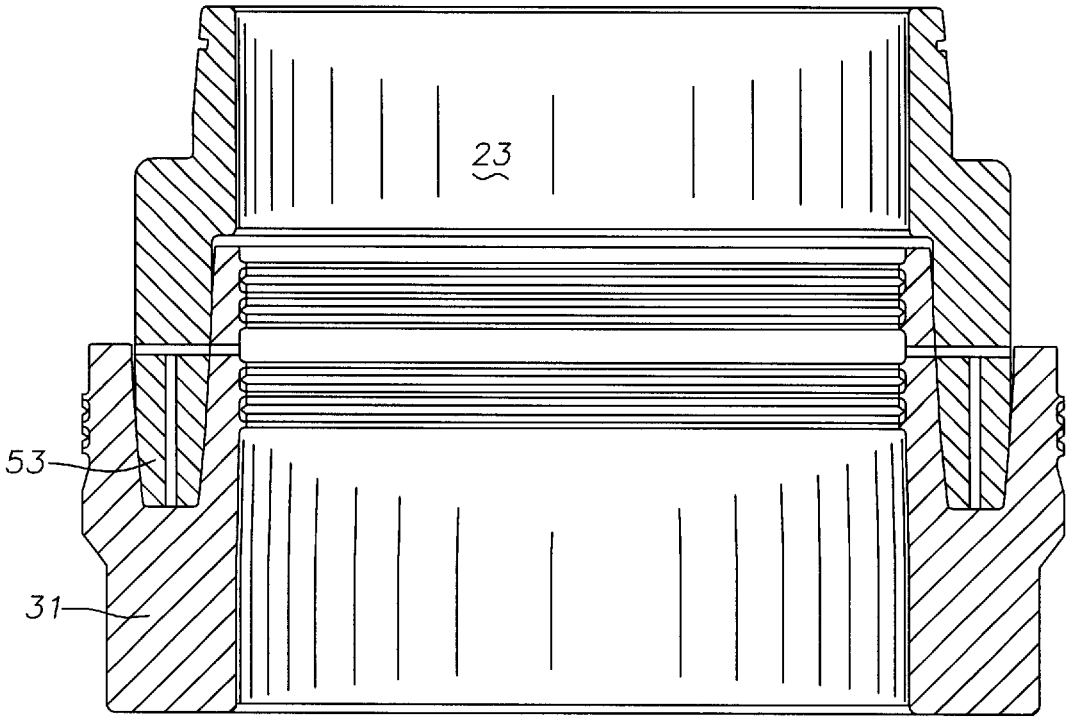
FIG. 3 is a sectional view of the packoff of FIG. 1 shown after energizing.

In the operation of the embodiment of FIGS. 1, 2 and 3, stop 101 is placed between the casing exterior wall 25 and wellhead housing bore 13. Backstop 105 rests against shoulder 106 and seal 103 is on top of stop 101. The inward surface of bowl 77 and the outward surface of slips 75 are placed in abutment with each other. Wedges 87 of slips 75 engage wedge 95 and slot 97 of bowl 77. Then, slips 75 and bowl 77 is positioned to matingly accept the upward protruding part 108 of stop 101. Slips 75 grip casing 24 and slide downward in bowl 77 to provide support for casing 24, as shown in FIG. 1.

The seal member 31 is placed into the pocket 27 between the casing exterior wall 25 and wellhead housing bore 13. Seal bands 51 will be closely spaced to the inner diameter of wellhead housing bore 13. Seal bands 49 will be closely spaced to the outer diameter of casing exterior wall 25. The energizing ring 53 is placed in the counterbore of bore 17, with shoulder 59 spaced below shoulder 61. Upper wellhead housing 15 is placed over lower wellhead housing 11 and energizer ring 53 placed in cavity 43, as shown in FIG. 2. Then, bolt 107 is used to bolt flanges 109, 111 of wellhead housings 11, 15 together. The energizing ring 53 moves downward and causes the inner and outer legs 33, 35 to move radially apart from each other, as shown in FIGS. 1 and 3. Seal bands 51 embed into inner diameter of wellhead housing bore 13 while seal bands 49 embed into outer diameter of casing exterior wall 25. An instrument connected to the exterior opening 71 of passage 69 allows testing for a proper seal of gasket seal 19 between housings 11, 15 and a proper seal of the seal assembly 29.

Figure 4:
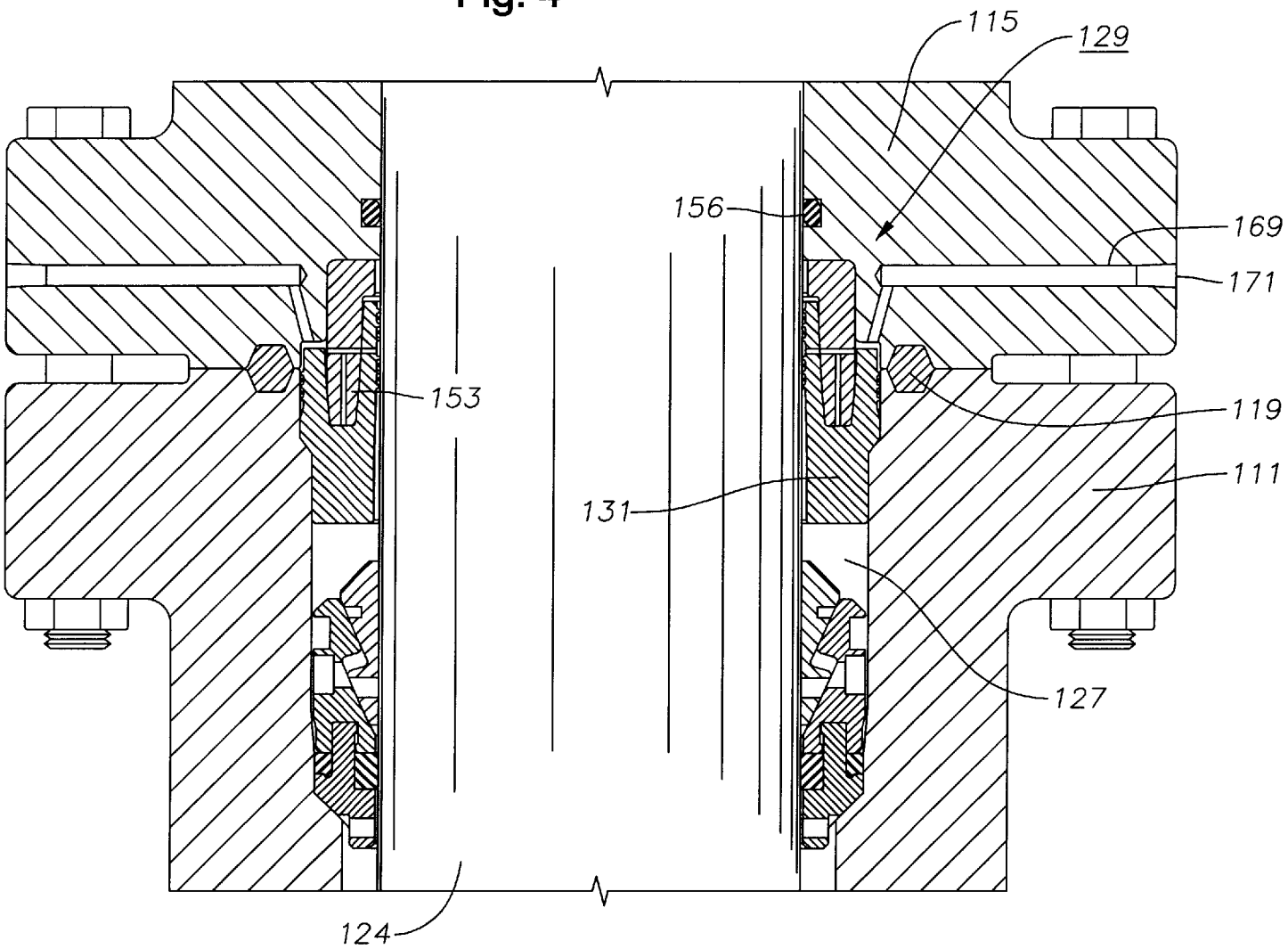
FIG. 4 is a sectional view of an alternate embodiment of the packoff of FIG. 1 shown after energizing.

Referring now to FIG. 4, a second embodiment of the present invention is depicted as seal assembly 129. Like seal assembly 29, seal assembly 129 is made of metallic components and lands in a pocket 127 between the exterior of a string of casing 124 and the bore of a wellhead housing 111. Seal assembly 129 has an annular seal member 131 that is identical to seal member 31, and includes a set of slips therebelow as described above. Seal assembly 129 also has an energizing ring 153 that is almost identical to energizing ring 53, except that energizing ring 153 does not have upper portion 63. Since energizing ring 153 does not have an upper portion 63, conventional wellhead sealing means 156 are used in conjunction with seal assembly 129 to seal the wellhead housing above energizing ring 153.

In operation, seal member 131 is landed in lower wellhead housing 111 and an upper wellhead housing 115 is placed over lower wellhead housing 111 with energizer ring 153 therebetween. When wellhead housings 111, 115 are bolted together, energizing ring 153 energizes and seals in the same manner as described above for seal assembly 29. As previously mentioned, a conventional seal 156 is used to seal above energizing ring 153. An instrument connected to the exterior opening 171 of passage 169 allows testing for a proper seal of gasket seal 119 between housings 111, 115 and a proper seal of the seal assembly 129.

The present invention has several advantages, including the ability to provide a metal-to-metal annular packoff over raw or unmachined casing in a straight bowl diameter. The design of the packoff allows an upper wellhead housing to energize the seal when it is bolted to the lower wellhead housing, thereby eliminating the prior art need for a running tool to accomplish the same function.

While the present invention has been shown or described in only some of its forms, it should be apparent to those skilled in the art that it is not so limited, but is susceptible to various changes without departing from the scope of the invention.

What is claimed is:

1. An apparatus for sealing between upper and lower wellhead housings, the wellhead housings having coaxial bores with a string of casing extending therethrough, the apparatus comprising:

a tubular member adapted to be landed between the bore of the lower wellhead housing and the string of casing, the tubular member having a pair of legs extending generally upward therefrom that define a channel; and an energizer member adapted to be located between the bore of the upper wellhead housing and the string of casing, wherein, when the upper wellhead housing is mounted to the lower wellhead housing, the energizer member is forced into the channel to energize the tubular member and effect a seal between the bores of the wellhead housings and the casing.

2. The apparatus of claim 1 wherein the apparatus forms an all-metallic seal.

3. The apparatus of claim 1, further comprising sealing bands on inner and outer surfaces of the tubular member.

4. The apparatus of claim 1 wherein the energizer member has an upper portion that is adapted to seal to the bore of the upper wellhead housing.

5. The apparatus of claim 1 wherein the legs of the tubular member are substantially parallel.

6. The apparatus of claim 1 wherein the energizer member has a radial dimension that is greater than a radial dimension of the channel, such that the legs of the tubular member are forced apart when the tubular member is energized.

7. A packoff for sealing between upper and lower wellhead housings, the wellhead housings having coaxial bores with a string of casing extending therethrough, the packoff comprising:

a metallic, annular seal member adapted to be landed between the bore of the lower wellhead housing and the string of casing, the seal member having a pair of legs extending generally upward therefrom that define a channel;

sealing bands located on inner and outer surfaces of the seal member; and an energizer member adapted to be located between the bore of the upper wellhead housing and the string of casing, wherein, when the upper wellhead housing is mounted to the lower wellhead housing, the energizer member is forced into the channel to energize the seal member and effect a seal between the bores of the wellhead housings and the casing.

8. The packoff of claim 7 wherein the energizer member has an upper portion that is adapted to seal to the bore of the upper wellhead housing.

9. The packoff of claim 7 wherein the legs of the seal member are substantially parallel.

10. The packoff of claim 7 wherein the energizer member has a radial dimension that is greater than a radial dimension of the channel, such that the legs of the seal member are forced apart when the seal member is energized.

11. A method of sealing between upper and lower wellhead housings, the wellhead housings having coaxial bores with a string of casing extending therethrough, the apparatus comprising:

(a) providing a tubular member between the bore of the lower wellhead housing and the string of casing, the tubular member having a pair of legs extending generally upward therefrom that define a channel;

(b) providing an energizer member between the bore of the upper wellhead housing and the string of casing; and then (c) lowering the upper wellhead housing onto the lower wellhead housing, such that the energizer member is forced into the channel to energize the tubular member and effect a seal between the bores of the wellhead housings and the casing.

12. The method of claim 11, further comprising the step of providing sealing bands between inner and outer surfaces of the tubular member, and the string of casing and the bore of the lower wellhead housing, respectively.

13. The method of claim 11, further comprising the step of sealing the bore of the upper wellhead housing with an upper portion of the energizer member.

14. The method of claim 11 wherein step (c) comprises forcing the legs of the tubular member apart when the tubular member is energized.

* * * * *